United States Patent [19]

Viitanen et al.

[11] Patent Number: 4,542,593

[45] Date of Patent: Sep. 24, 1985

[54] APPARATUS FOR IMPROVING HEAT TRANSFER IN DRYING CYLINDERS OF A PAPER MACHINE AND METHOD FOR ASSEMBLING THE SAME

[75] Inventors: Olavi Viitanen; Reima Kerttula, both of Jyväskylä, Finland

[73] Assignee: Valmet Oy, Finland

[21] Appl. No.: 584,340

[22] Filed: Feb. 28, 1984

[30] Foreign Application Priority Data

Mar. 1, 1983 [FI] Finland ..... 830676

[51] Int. Cl.[4] ..... F26B 13/18

[52] U.S. Cl. ..... 34/41; 34/119; 34/124

[58] Field of Search ..... 34/41, 110, 119, 121, 34/124; 165/89

[56] References Cited

U.S. PATENT DOCUMENTS

| | | | |
|---|---|---|---|
| 3,217,426 | 11/1965 | Barnscheidt et al. | 34/110 |
| 3,724,094 | 4/1973 | Appel et al. | 34/124 |
| 4,155,177 | 5/1979 | Justus | 34/110 |
| 4,195,417 | 4/1980 | Mathews | 34/110 |
| 4,267,644 | 5/1981 | Schiel | 34/119 |
| 4,282,656 | 8/1981 | Schiel | 34/119 |
| 4,385,455 | 5/1983 | Withers et al. | 34/110 |
| 4,486,962 | 12/1984 | Wedel | 34/119 |

FOREIGN PATENT DOCUMENTS

| | | |
|---|---|---|
| 2330199 | 3/1975 | Fed. Rep. of Germany . |
| 2849454 | 7/1980 | Fed. Rep. of Germany . |
| 2844273 | 9/1980 | Fed. Rep. of Germany . |
| 2903784 | 5/1981 | Fed. Rep. of Germany . |
| 2846414 | 5/1982 | Fed. Rep. of Germany . |
| 62694 | 10/1982 | Finland . |

*Primary Examiner*—Larry I. Schwartz
*Assistant Examiner*—David W. Westphal
*Attorney, Agent, or Firm*—Steinberg & Raskin

[57] ABSTRACT

Apparatus for increasing the turbulence of a condensate layer formed on the inner surface of a mantle of a drying cylinder for use in the drying seciton of a paper machine to improve its heat transfer characteristics include a plurality of turbulence ribs atached to the inner mantle surface by a plurality of attachment bands, each attachment band being constituted by an assembly of at least three band parts. Spring devices are associated with pairs of adjacent free ends of the band parts of each attachment band to urge the adjacent free ends away from each other. The spring devices are tensioned by tensioning devices and the turbulence ribs are attached to the bands, which are preferably evenly space throughout the axial length of the mantle, by corresponding projections and cavities. The apparatus is installed according to a method wherein the band parts are inserted through an access opening provided in the drying cylinder mantle whereupon the attachment bands are assembled from the band parts within the cylinder mantle. The spring devices of at least one central attachment band are tensioned at a higher tensioning force than the other lateral bands.

12 Claims, 8 Drawing Figures

APPARATUS FOR IMPROVING HEAT TRANSFER IN DRYING CYLINDERS OF A PAPER MACHINE AND METHOD FOR ASSEMBLING THE SAME

BACKGROUND OF THE INVENTION

This invention relates generally to the field of paper making and, more particularly, to methods and apparatus in a drying section of a paper machine.

More specifically, the present invention relates to apparatus in the drying cylinders of a paper machine for improving the heat transfer characteristics of the drying cylinders. The apparatus is situated on the inner surface of the cylindrical mantle of the drying cylinder to increase the turbulence of the condensate layer which forms on the inner surface during operation to thereby improve the heat transfer in the drying cylinder during the paper making operation. The apparatus comprises a plurality of turbulence ribs attachable to the inner surface of the mantle of a drying cylinder by means of attachment bands and tensioning means.

It is known that water is condensed on the inner surface of a steam heated drying cylinder in a drying section during operation of the paper machine. The water is removed by any one of a number of known suction arrangements and in this connection reference is made to Finnish Pat. No. 62,694 of Feb. 10, 1983, assigned to the assignee of the instant application.

The presence of condensate on the inner surface of the drying cylinder mantle inhibits the heat transfer from the steam within the cylinder to the outer surface thereof. In order to overcome this problem the provision of ribs on the inner surface of the drying cylinders has been suggested to convert the laminar flow of the condensate water into a turbulent flow to thereby improve the heat transfer through the condensate layer. In this connection ribs have been attached to the inner surface of the drying cylinder mantle in various ways. Additionally, ribs have been machined so as to extend integrally from the inner surface of the cylinder mantle in the axial or radial direction whereby heat transfer is improved within the region over which the ribs are effective. Furthermore, various types of nets or similar constructions have been used in addition to ribs to convert the laminar condensate flow to a turbulent flow.

Reference is made to the following patents which exemplify the prior art pertaining to the present invention:

SE Pat. Appln. No. 78-066,040 (Beloit Corp.), DE Pat. No. 2,330,199 (J. M. Voith GmbH), DE-AS No. 2,844,273 and DE-OS No. 2,846,414 (Escher Wyss GmbH), DE-AS No. 2,849,454, and DE-AS No. 2,903,784 (J. M. Voith GmbH), U.S. Pat. No. 3,724,094 (Kimberly-Clark Corp.), and U.S. Pat. No. 4,195,417 (Beloit Corp.).

The known arrangements for providing ribs on the inner surface of a drying cylinder mantle have several drawbacks. In particular, the construction of such arrangements is generally quite complicated and the cost of manufacture has generally been quite high. Moreover, the installation of known rib arrangements in position has been found quite difficult. The manufacture of machined or integral ribs as well as the installation of certain prior art rib arrangements in drying cylinders that are in use is generally not possible without having to detach and disassemble the drying cylinder which of course is undesirable from the standpoint of the output of the paper machine.

Another serious problem of known rib arrangements is encountered in attempting to obtain a reliable fastening or attachment of the rib arrangements to the inner surface of the drying cylinder mantle. This problem arises from the fact that the ribs and the means provided for attaching the ribs to the drying cylinder are installed within the drying cylinder while the latter is cold. It has been found that when the paper machine is run and hot steam supplied into the drying cylinders which of course significantly increases the temperature thereof, various parts of the drying cylinder and rib arrangements undergo thermal expansion of relatively different magnitudes. The turbulence ribs may obtain a curved or warped configuration due to such thermal expansion whereupon the ribs may become detached from the inner surface of the drying cylinder mantle. Such phenomena detracts from the proper functioning of the rib arrangement which in turn results in an uneven temperature profile over the outer surface of the drying cylinder.

SUMMARY OF THE INVENTION

Accordingly, it is an object of the present invention to provide new and improved turbulence rib arrangements in drying cylinders of paper machines which avoid the drawbacks of conventional arrangements as described above.

Another object of the present invention is to provide new and improved turbulence rib arrangements which will provide a substantially even moisture profile for the drying cylinders and which will thereby increase the average evaporation of moisture from a paper web passing through the paper machine.

Still another object of the present invention is to provide new and improved turbulence rib arrangements which will remain reliably attached to the inner surface of the drying cylinder mantle during operation.

A further object of the present invention is to provide new and improved turbulence rib arrangements and wherein the attachment of the turbulence ribs to the inner surface of the drying cylinder mantle can be accomplished without the necessity of drilling bores in or welding attachment parts to the wall of the drying cylinder mantle while at the same time achieving a reliable attachment of the turbulence ribs.

A still further object of the present invention is to provide new and improved methods of installing a turbulence rib arrangement in drying cylinders whereby such installation can be accomplished more rapidly and more economically than has been possible heretofore.

Yet another object of the present invention is to provide new and improved turbulence rib arrangements wherein the components thereof can be inserted through an access opening provided in at least one of the axial ends of the drying cylinder mantle such that the turbulence rib arrangement can be installed within the drying cylinder thereby eliminating the necessity of detaching and disassembling the drying cylinder.

Briefly, in accordance with the present invention, these and other objects are attained by providing a rib arrangement comprising components having a size and configuration such that the components can be inserted into the hollow space defined within the drying cylinder mantle through an access opening provided at one end thereof and which components can be assembled within the drying cylinder mantle.

The rib arrangement includes a plurality of attachment bands, each band being constituted by an assembly of at least three arcuate-shaped band parts, the attachment bands being situated within the drying cylinder mantle in mutually axially spaced relationship. A plurality of turbulence ribs are positioned so as to extend in a substantially axial direction through the hollow interior space of the mantle adjacent to the inner surface thereof and are attached to the attachment bands, preferably at a substantially uniform spacing. In a preferred embodiment, the turbulence ribs are attached to the bands by means of corresponding projections and cavities.

Spring means are associated with pairs of adjacent free ends of the band parts in each attachment band for urging the adjacent free ends away from each other and suitable means are provided for tensioning the spring means.

Several important advantages of diverse nature are obtained by the present invention. For example, the fastening of the turbulence ribs to the inner surface of the drying cylinder mantle as well as their axial and radial positions can be controlled over the entire temperature range to which the drying cylinders are subjected. When the spring means described above incorporate springs which provide a spring force between the arcuate-shaped band parts which is adjustable, a reliable fastening of the turbulence ribs to the inner mantle surface can be achieved in spite of thermal expansion.

According to a preferred embodiment of the invention, one or more of the attachment bands situated centrally in the axial direction within the drying cylinder mantle are provided with spring means which provide greater tension or which can be tensioned with a higher force relative to the spring means associated with the attachment bands situated laterally thereof. In this manner the turbulence ribs will expand from their central regions toward both of their ends which allows the axial shifting of the turbulence ribs to be controlled.

DETAILED DESCRIPTION OF THE DRAWINGS

A more complete understanding of the present invention and many of the attendant advantages thereof will be readily appreciated as the same becomes better understood by reference to the following detailed description when considered in connection with the accompanying drawings, in which.

DESCRIPTION OF THE PREFERRED EMBODIMENTS

Figure 1:
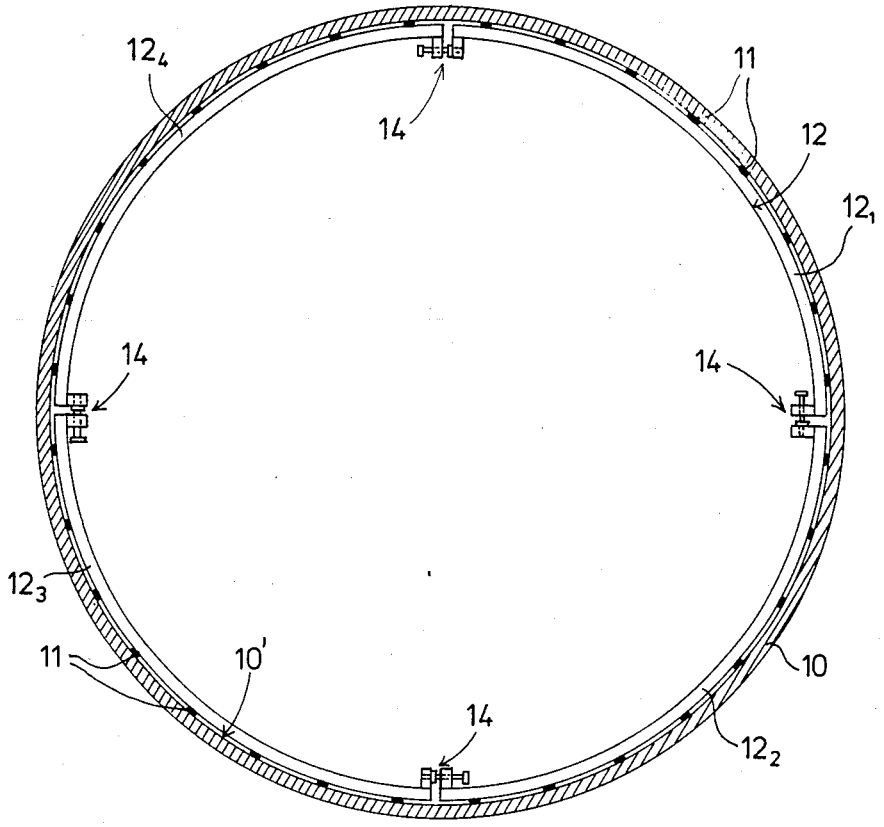
FIG. 1 is a transverse cross-sectional view of a drying cylinder provided with a rib arrangement in accordance with the present invention.
Figure 2:
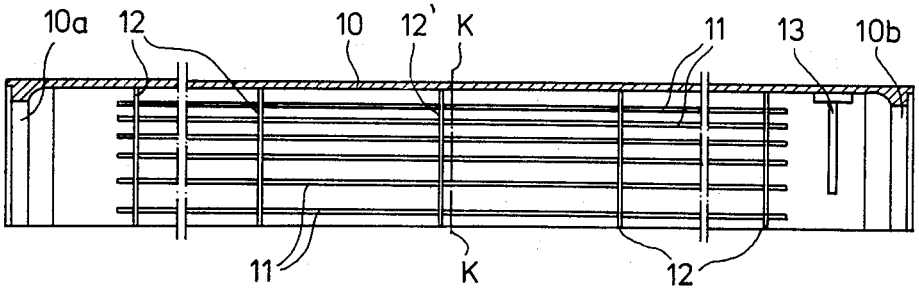
FIG. 2 is a partial longitudinal cross-sectional view of a drying cylinder illustrated in FIG. 1.

Referring now to the drawings wherein like reference characters designate identical or corresponding parts throughout the several views, and more particularly to FIGS. 1 and 2, a cylindrical mantle 10 of a drying cylinder is illustrated. The mantle 10 defines a hollow interior space bounded by an inner smooth mantle surface 10' and is provided with end collars 10*a* and 10*b* to which the ends of the cylinder (not shown) are fixed in a known manner. The end of the mantle is provided with a manhole or access opening through which the components of the rib arrangement can be inserted into the interior mantle space should it be desired to provide a drying cylinder already in use with a turbulence rib arrangement in accordance with the invention.

Figure 3:
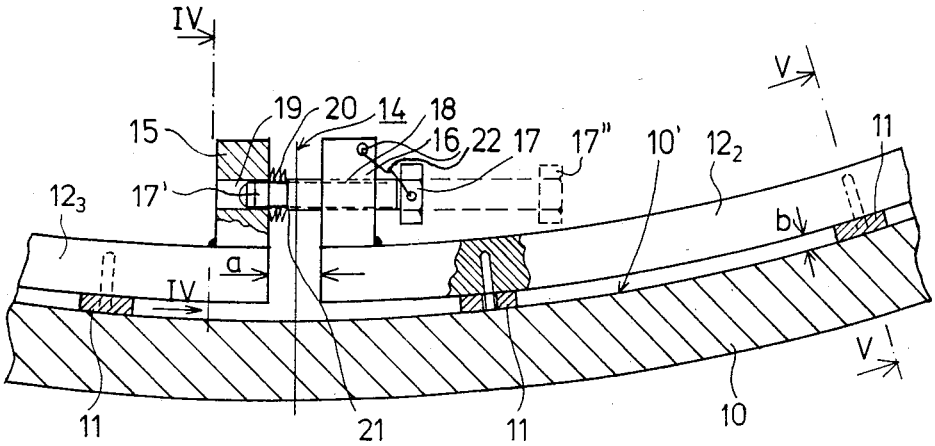
FIG. 3 is an enlarged detail view of a portion of the drying cylinder illustrated in FIG. 1 and showing the spring and tensioning means associated with a pair of adjacent free ends of band parts of an attachment band.

A rib arrangement in accordance with the invention assembled within the drying cylinder is illustrated in FIGS. 1–3. The rib arrangement includes a plurality of turbulence ribs 11 which extend in a substantially axial direction through the hollow interior space of the mantle. In the illustrated embodiment, a total of 32 turbulence ribs are situated with substantially uniform inter-rib spacing against the inner surface 10' of the mantle. The ribs 11 preferably extend over substantially the entire effective length of the drying cylinder, i.e., the length of the drying cylinder which the paper web to be dried contacts during operation of the paper machine.

The ribs 11 are attached to the inner mantle surface by means of a plurality of attachment bands 12. In the illustrated embodiment, seven such attachment bands 12 are provided and are situated with a substantially uniform inter-band spacing. Preferably, an odd number of attachment bands 12 are used and the central band in the axial direction, designated 12', is situated in or near the central plane K—K of the drying cylinder 10. In this manner an equal number of attachment bands 12 are situated on each side of the central band 12'.

Figure 5:
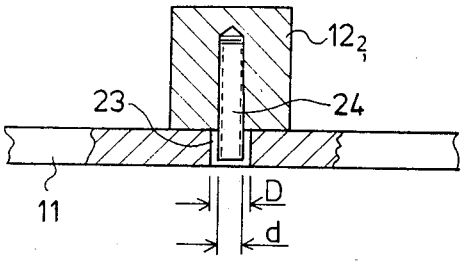
FIG. 5 is a section view taken along line V—V of FIG. 3.

As best seen in FIGS. 3 and 5, the turbulence ribs 11 are attached to the attachment bands 12 by means of projections in the form of pins 24. The pins 24, which may comprise conventional or spring-type keys, are embedded within the thickness of the attachment bands 12. The turbulence ribs 11 are provided with cavities in the form of bores 23 which are adapted to receive the pins 24. Thus, the pins 24 are mutually spaced from each other by distances corresponding to the spacing of the turbulence ribs while the bores 23 which are adapted to receive corresponding pins 24 are mutually spaced from each other by distances determined by the number and spacing of the attachment bands 12. Moreover, the diameter D of each bore 23 is greater than the diameter d of the corresponding pin 24 which is received therein. The length of the pins 24 which project beyond the outer face of the bands 12 is less than the thickness of the ribs 11. The ribs 11 are made of suitable material such, for example, as flat iron, and preferably have a rectangular cross-section so that their width is 2 to 5 times their thickness. As will be understood from FIG. 5, by providing that the diameter D of bores 23 are greater than the diameters d of pins 24, i.e., by providing a loose pin-to-bore fitting, an attachment of the ribs 11 is obtained such that the ribs can assume a position which will accommodate thermal expansion which accompanies heating of the drying cylinder, especially in the longitudinal direction. By way of example, the diameter D of bores 23 is about 6 mm and the diameter d of the pins 24 is about 4 mm.

According to the invention, each attachment band 12 is constituted by an assembly of at least three arcuate-shaped band parts $12_N$. In the illustrated embodiment, each band 12 is assembled of four band parts $12_1$, $12_2$, $12_3$ and $12_4$. Each band part of an attachment band has a pair of free ends and the band parts are situated with each free end of one band part being situated adjacent to a respective free end of another band part to form pairs of adjacent free ends.

Figure 4:
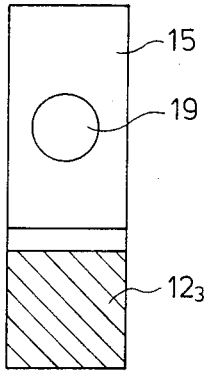
FIG. 4 is a section view taken along line IV—IV of FIG. 3.

Referring to FIG. 3, adjacent free ends of adjoining band parts $12_N$ of an attachment band are connected with each other by spring means in the form of spring joints 14. Referring to FIGS. 3 and 4, a spring joint 14 associated with a pair of adjacent free ends of adjoining band parts is illustrated. The spring joint 14 is formed by flanges 15 and 16 welded to the respective adjacent free ends of adjoining band parts. A threaded bore 16 is formed through flange 16 and a screw 17 having threads 18 is threadedly fitted within the threaded bore. The screw 17 has a shank in which a shoulder 21 is formed having a surface which faces the flange 15. The portion 17' of the shank of screw 17 which extends between its free end and the shoulder 21 is unthreaded and is received within a smooth bore 19 formed in flange 15. A cup-spring pack 20 is fitted over the unthreaded portion 17' of screw 17, the ends of the spring pack 20 bearing against the shoulder 21 of screw 17 and the outer surface of flange 15. The cup-spring pack 20 may, for example, comprise 5 to 11 cup-springs by means of which a sufficient spring distance is obtained with an appropriate spring force where the distance a between flanges 15 and 16 is varied such, for example, as a result of thermal expansion.

As noted above, each attachment band 12 is constituted by an assembly of at least three arcuate-shaped band parts $12_N$ with four such band parts (and four spring joints 14) being illustrated in the preferred embodiment. When this condition is met, the band parts $12_N$ will fit into the interior space within the drying cylinder mantle through the access opening provided at its end. The number of turbulence ribs 11 is selected such that it is divisible by the number of band parts $12_N$. Thus, in the illustrated embodiment, the number of turbulence ribs should be divisible by four.

Figure 6A:
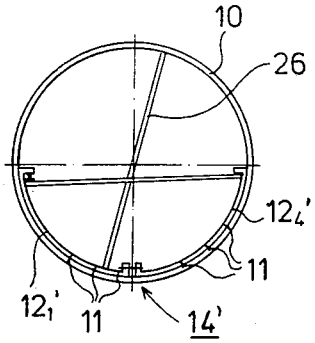
FIGS. 6A, 6B and 6C illustrate the steps in the installation within a drying cylinder of a rib arrangement in accordance with the present invention.
Figure 6B:
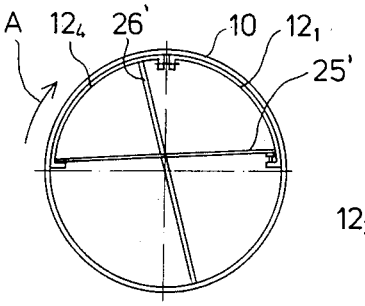
Figure 6C:
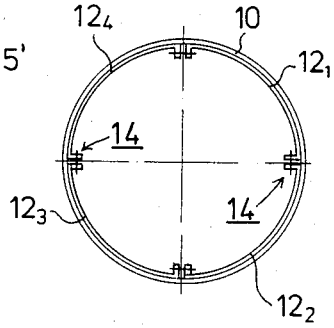

Referring mainly to FIGS. 6A, 6B and 6C, the assembly and installation of the rib arrangement in accordance with the invention within the mantle 10 of the drying cylinder will be described. In this connection, it is noted that the drying cylinder is illustrated in its position of operation in the drying section of the paper machine.

The components of the rib arrangement are inserted into the interior mantle space through the access opening provided at the end of the mantle. In this connection, it is of course understood that during operation, the access opening is closed by a suitable end cap. As will be understood from the foregoing, the rib arrangement is assembled from components having a relatively small size and a configuration which allow the same to fit well in through the access opening and to transport to the site of installation is also easy since the rib arrangement components can be packaged in a relatively small space.

Referring to FIG. 6A, in the first stage of assembly of the rib arrangement, the turbulence ribs 11 are appropriately situated along the lower half of the inner surface 10' of the mantle 10. Two band parts $12_1'$ and $12_4'$ are attached to the ribs by the pin and bore connections described above whereupon a spring joint 14' is fastened and tensioned at an appropriate tightness. In this manner, the turbulence ribs 11 are situated in their proper position and supported by the pins 24 on the band parts $12_1'$ and $12_4'$. The two band parts $12_1'$ and $12_4'$ thus constitute one-half of an attachment band 12 and is wedged and supported in its position by means of support rods 25 and 26 which may take the form of boards cut to an appropriate length.

Referring to FIG. 6B, the drying cylinder is then rotated in the direction of arrow A through about 180° while the arrangement comprising the turbulence ribs 11 and the half of the attachment band 12 formed by band parts $12_1$ and $12_4$ are supported by support rods 25 and 26. At this stage (illustrated in FIG. 6B), the ribs 11 and band parts $12_2$ and $12_3$ constituting the other half of the rib arrangement are fitted into their appropriate positions. All of the spring joints 14 are then suitably tensioned so that the cup-spring packs 20 are substantially straightened, i.e., the screws 17 are tightened to provide maximum tension between adjoining band parts. The attachment bands 12 formed in this manner are then preferably impacted by a hammer or the like whereupon the screws 17 are somewhat slackened. Security wiring 22 (FIG. 3) is preferably provided to prevent inadvertent rotation of the screws 17 during operation.

The rib arrangement can also be installed in a manner such that after the lower half of the arrangement has been installed as seen in FIG. 6A, one or more additional band parts are situated against the upper part of the inner mantle surface and additional turbulence ribs pushed from the top into their appropriate positions. This is possible when the clearance a (FIG. 3) is about zero.

According to a preferred embodiment of the invention, the central band 12' or two or more attachment bands 12 situated substantially at the axially central region of the mantle are provided with spring joints 14 having stronger or stiffer springs 20 than the spring joints of the bands 12 situated laterally thereof. Alternatively, the spring joints of the central attachment band or bands 12' can be tensioned more tightly than the spring joints of the lateral attachment bands, i.e., so as to cause the attachment bands in the central region of the drying cylinder mantle to press with a greater force against the outer faces of the turbulence ribs 11. In this manner, the turbulence ribs will shift due to thermal expansion in a manner such that their mid-portions will remain in position with only their end portions being shifted.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In drying cylinder apparatus for use in a drying section of a paper machine, said apparatus including a drying cylinder having a cylindrical mantle defining a hollow interior space bounded by an inner mantle surface and means for increasing the turbulence of a condensate layer formed on said inner mantle surface during operation of the drying cylinder to improve the heat transfer characteristics of the drying cylinder, said means including a plurality of turbulence ribs attached to said inner mantle surface, the improvement comprising:

a plurality of turbulence ribs attached to said inner mantle surface and extending in a substantially axial direction through said hollow interior space of said mantle;

means for attaching said plurality of turbulence ribs to said inner mantle surface, said attaching means including a plurality of attachment bands situated in said hollow interior space of said mantle in mutually axially spaced relationship, each band extending substantially circumferentially around said hollow interior space of said mantle adjacent to said inner surface thereof, each attachment band being constituted by an assembly of at least three arcuate-shaped band parts, each band part having a pair of free ends with each free end of one band part being situated adjacent to a respective free end of another band part to form pairs of adjacent free ends, spring means associated with at least one of said pairs of adjacent free ends of said band parts in each attachment band for urging said adjacent free ends away from each other, said spring means exerting a force substantially in the same direction that the free ends move away from each other, means for tensioning said spring means, and means for attaching said turbulence ribs to said attachment bands.

2. The combination of claim 1 wherein said means for attaching said turbulence ribs to said attachment bands includes one of cavities and projections formed on said turbulence ribs and the other of said cavities and projections formed on said attachment bands, each cavity adapted to receive a corresponding projection.

3. The combination of claim 2 wherein said means for attaching said turbulence ribs to said attachment bands include a plurality of projections in the form of pins attached to each of said band parts and extending from their outer circumference, said pins being mutually spaced from each other by distances corresponding to the spacing of said turbulence ribs, and a plurality of cavities in the form of bores formed in each of said turbulence ribs, said bores adapted to receive corresponding pins and being mutually spaced from each other by distances determined by the number and spacing of said attachment bands, and wherein said bores have a diameter which is greater than the diameter of corresponding ones of said pins adapted to be received therein.

4. The combination of claim 1 wherein said spring means and tensioning means include a flange provided on each free end of said at least one pair of adjacent free ends of said band parts, one of said flanges having a threaded bore formed therethrough, a tensioning screw threadedly fitted within said threaded bore and extending towards the other of said flanges, a shoulder formed in a shank of said tensioning screw, and a spring element having a pair of ends bearing against said tensioning screw shoulder and said other of said flanges.

5. The combination of claim 4 wherein a bore is formed in said other of said flanges and wherein a free end of said tensioning screw is received in said bore.

6. The combination of claim 4 wherein said spring element comprises a cup-spring pack including at least two cupsprings situated against each other.

7. The combination of claim 1 wherein said attachment bands situated in said hollow interior space of said mantle are mutually spaced from each other at substantially equal distances.

8. The combination of claim 1 wherein said plurality of attachment bands include at least one band situated substantially centrally in the axial direction within said hollow interior space of said mantle and attachment bands situated laterally of said at least one central band, and wherein said spring means associated with said at least one central band urge said adjacent free ends of said band parts thereof away from each other with a greater force than said spring means associated with said lateral attachment bands, whereby axial shifting produced by thermal expansion of said turbulence ribs during operation can be controlled.

9. The combination of claim 1 wherein said drying cylinder mantle has an access opening provided at at least one of its axial ends and wherein said attachment band parts are of a size and configuration such that the same are receivable in said hollow interior space within said mantle through said access opening and assemblable within said hollow interior space.

10. The combinatin of claim 1, wherein said inner mantle surface is substantially devoid of bores.

11. A method of installing means for increasing the turbulence of a condensate layer formed on the inner surface of a cylindrical mantle of a drying cylinder for use in the drying section of a paper machine to improve the heat transfer characteristics thereof, the mantle having an access opening provided at at least one of its axial ends, comprising the steps of:

inserting a plurality of turbulence ribs through the access opening of the mantle and positioning the same against the inner mantle surface so as to extend in a substantially axial direction through the hollow interior space of the mantle;

inserting a plurality of arcuate-shaped band parts through the mantle access opening;

assembling the band parts within the hollow interior space of the mantle to form a plurality of attachment bands, each attachment band being constituted by an assembly of at least three of the arcuate-shaped band parts with the free ends of each band part being situated adjacent to a respective free end of another band part to form pairs of adjacent free ends and by associating spring means with at least one of the pairs of adjacent free ends of the band parts to urge the adjacent free ends away from each other, said spring means exerting a force substantially in the same direction that the free ends move away from each other, the attachment bands so formed being mutually axially spaced from each other in the axial direction within the hollow interior space of the mantle;

attaching the attachment bands to the turbulence ribs; and tensioning the spring means.

12. The method of claim 11 wherein the attachment bands include at least one band situated substantially centrally in the axial direction within the hollow interior space of the mantle and attachment bands situated laterally of the at least one central band, the method comprising the further step of tensioning the spring means associated with the at least one central band so that the spring means urge the adjacent free ends of the band parts of the at least one central band away from each other with a greater force than the spring means associated with the lateral attachment bands.

* * * * *